US005970868A

United States Patent [19]

Kimura et al.

[11] Patent Number: 5,970,868

[45] Date of Patent: Oct. 26, 1999

[54] STAMP CASSETTE FOR THERMAL STENCIL PAPER

[75] Inventors: Masaru Kimura; Seita Suzuki, both of Shiga-ken, Japan

[73] Assignee: General Co., Ltd., Osaka, Japan

[21] Appl. No.: 09/074,494

[22] Filed: May 8, 1998

Related U.S. Application Data

[62] Division of application No. 08/692,468, Aug. 6, 1996.

[30] Foreign Application Priority Data

Aug. 11, 1995 [JP] Japan ..... 7-205668
May 9, 1998 [JP] Japan ..... 8-114754

[51] Int. Cl.[6] ..... B05C 17/06

[52] U.S. Cl. ..... 101/128.21; 101/125

[58] Field of Search ..... 101/114, 125, 101/128.21, 128.4, 127; 400/208, 613

[56] References Cited

U.S. PATENT DOCUMENTS

| | | | |
|---|---|---|---|
| 3,595,166 | 7/1971 | Sherman | 101/128.2 |
| 3,799,053 | 3/1974 | Rabelow | 101/125 |
| 3,886,863 | 6/1975 | Carabott et al. | 101/125 |
| 4,348,953 | 9/1982 | Cole et al. | 101/128.21 |
| 4,986,175 | 1/1991 | Boehringer et al. | 101/125 |
| 5,184,549 | 2/1993 | Imamaki et al. | 101/121 |
| 5,195,832 | 3/1993 | Fujikawa et al. | 101/128.21 |
| 5,251,567 | 10/1993 | Fuwa | 101/128.4 |
| 5,253,581 | 10/1993 | Miki et al. | 101/121 |
| 5,285,725 | 2/1994 | Imamaki et al. | 101/127.1 |
| 5,329,848 | 7/1994 | Yasui et al. | 101/125 |
| 5,669,299 | 9/1997 | Ando et al. | 101/125 |
| 5,799,577 | 9/1998 | Takahashi | 101/114 |

FOREIGN PATENT DOCUMENTS

| | | |
|---|---|---|
| 0 493 965 | 7/1992 | European Pat. Off. . |
| 0 681 919 | 11/1995 | European Pat. Off. . |
| 0 725 116 | 8/1996 | European Pat. Off. . |
| 5-330215 | 12/1993 | Japan . |
| 2 277 058 | 10/1994 | United Kingdom . |

*Primary Examiner*—Ren Yan
*Attorney, Agent, or Firm*—Fitzpatrick, Cella, Harper & Scinto

[57] ABSTRACT

A stamp cassette includes a thermal stencil paper and a transport-assistant tape housed in a stamp cassette housing. The thermal stencil paper and the transport-assistant tape are wound together in two layers about a core in the stamp cassette housing.

4 Claims, 4 Drawing Sheets

STAMP CASSETTE FOR THERMAL STENCIL PAPER

This application is a divisional of application Ser. No. 08/692,468, filed Aug. 6, 1996.

BACKGROUND OF THE INVENTION.

1. Field of the Invention

The present invention relates to a stamp and stamp cassette, and particularly relates to: a type of stamp wherein thermal stencil paper is engraved by means of thermal energy, and this is attached to an ink supply member and used; and a stamp cassette wherein the thermal stencil paper to be used for the aforementioned engraving is mounted by means of rolling in tape fashion.

2. Related Background Art

Regarding known stamps, there have been rubber stamps, ink-impregnated rubber stamps and so forth, and more recently, stamps easily manufactured by means of a thermal head ("Stamp Maker" manufactured by MAX Inc.) are known.

However, rubber stamps and ink-impregnated rubber stamps have the problems of high costs and time consumption for their engravings, because they are manufactured by means of carving or molding. On the other hand, stamps manufactured by means of the aforementioned thermal head are a practical application which utilizes direct engraving by means of the recent thermal stencil paper. However, concerning these stamps, there are problems such as the stamp and the original base being one unit, so that if there is an error in the engraving, the stamp becomes useless, and also incurs high costs when making multiple types of stamps.

SUMMARY OF THE INVENTION

The object of the present invention is to provide for a durable stamp wherein the original can be manufactured without requiring known complex engraving processes and wherein multiple types of printing and multiple copies thereof are available at low cost and high accuracy, and to provide for a stamp cassette wherein the thermal stencil paper to be used for the manufacturing of the aforementioned original is mounted by means of rolling onto the core in tape fashion.

The stamp of the present invention comprises: an ink supply member which has the ability to exchangeably attach engraved thermal stencil paper which is engraved by means of the thermal head; and a stamp holder wherein the aforementioned engraved thermal stencil paper attached to this ink supply member is received so as to oppose the stamping opening. The aforementioned thermal stencil paper is constructed by means of layering together a film which melts with heat and a porous supporting member, and the ink supply member is constructed by means of impregnating an open-pored microporous structure with ink. Further, the outer surfaces of the open-pored microporous structure of the ink supply member, other than the surfaces which are in contact with the thermal stencil paper, preferably is made impermeable to ink. Also, concerning the ink with which the open-pored microporous structure of the ink supply member is to be impregnated, the viscosity of the ink is 1,000–100,000 CPS and 2.5 or less on the Thixotropy Index.

Further, regarding the stamp cassette of the present invention, the thermal stencil paper to be employed in the aforementioned stamp of the present invention is rolled onto the core in tape fashion and mounted on the cassette. More specifically, the thermal stencil paper and the transport-assistant tape to reinforce the thermal stencil paper is rolled onto the core in a double layer. At the time of rolling the thermal stencil paper and the transport-assistant tape onto the core in a double layer, the thermal stencil paper may be rolled on without an adhesive agent, and/or a layer of water-repellent oil-repellent agent may be provided on the edge including the slit surface (the side of the tape formation) of the thermal stencil paper. This water-repellent oil-repellent agent layer may be formed by coating the edge portion thereof including the slit surface (the side of the tape formation) after the thermal stencil paper is rolled onto the core, or may be formed by means of slitting thermal stencil paper applied with water-repellent oil-repellent agent at given intervals, the aforementioned slitting being conducted at the positions where the water-repellent oil-repellent agent is applied.

DESCRIPTION OF THE PREFERRED EMBODIMENTS

Figure 1:
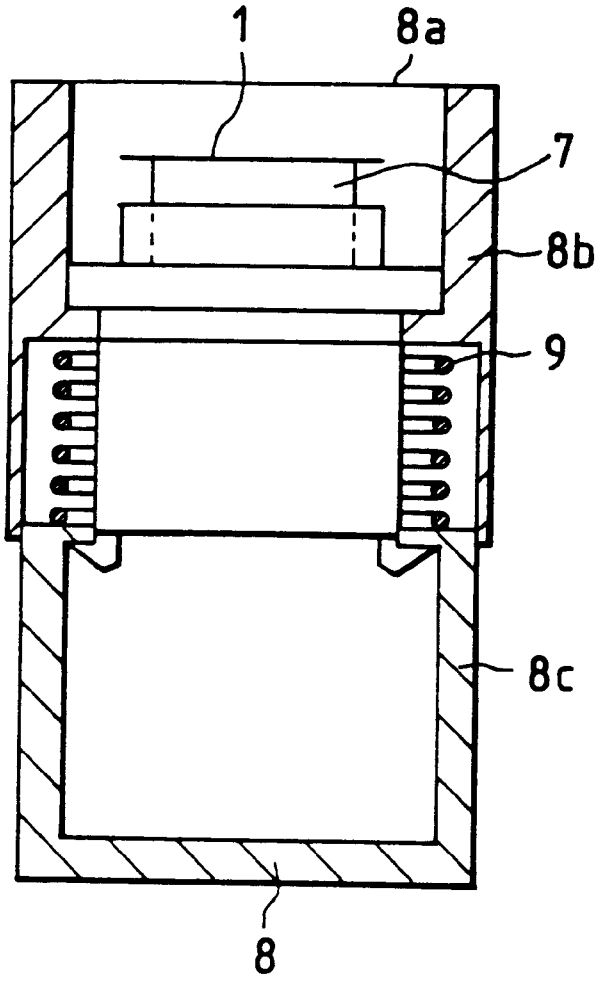
FIG. 1 is an explanatory diagram showing an embodiment of the stamp of the present invention.
Figure 2:
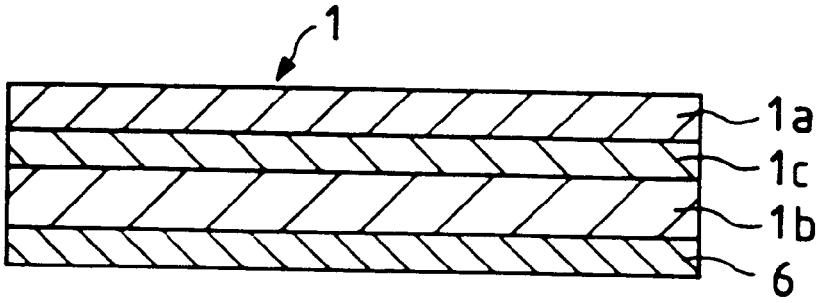
FIG. 2 is a cross-sectional diagram showing the construction of the thermal stencil paper which comprises the stamp of the present invention.
Figure 7:
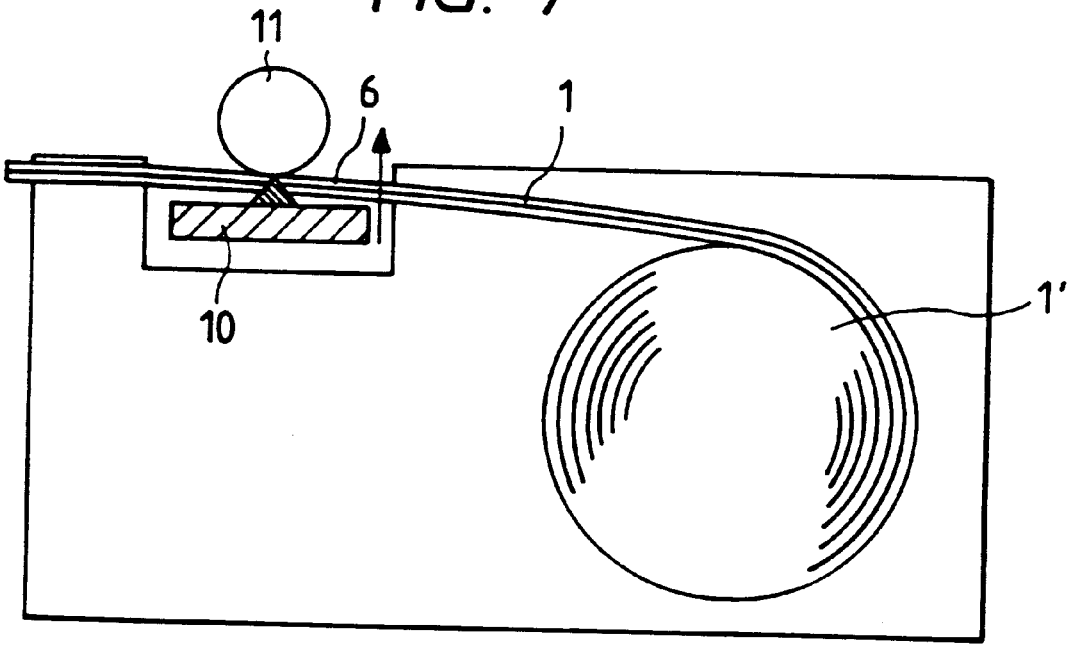
FIG. 7 is a schematic explanatory diagram of the method by which to engrave the thermal stencil paper which comprises the stamp of the present invention.

FIG. 1 shows one example of the construction of the stamp of the present invention. As shown in FIG. 7, thermal stencil paper 1 is engraved beforehand by means of a known thermal head 10 causing a platen roller 11 to press against a mother roll 1 comprised of, e.g., thermal stencil paper 1 and reinforcing tape 6. The stamp of the present invention comprises: an exchangeable ink supply member 7 to which the aforementioned thermal stencil paper 1 is affixed by means of, e.g., the surface tension of the ink alone; and a stamp holder 8 wherein the aforementioned engraved thermal stencil paper 1 attached to this ink supply member is received so as to oppose the stamping opening 8*a*. As FIG. 2 shows, the aforementioned thermal stencil paper 1 is constructed by means of layering together a film which melts with heat 1*a* and a porous supporting member 1*b*, and the ink supply member is constructed by means of impregnating a open-pored microporous structure 7*a* with the ink.

Then, when stamping, the aforementioned stamping opening 8*a* is positioned against the stamping position. By means of the stamp holder 8 being pressed against the like of repulsion of spring 9, the side of the holder main unit 8*c* and the ink supply member 7 to which is integrally attached the thermal stencil paper 1 moves relative to the cover 8*b* for the thermal stencil paper 1, and the thermal stencil paper 1 is pressed onto the stamping position, thus conducting stamping with the ink by which the open-pored microporous structure 7*a* is impregnated.

Regarding the open-pored microporous structure for the ink supply member which comprises the stamp of the present invention, urethane, NBR, silicone, fluorine, etc. may be employed.

According to the experiments conducted by the present inventor, regarding the aforementioned open-pored microporous structure, it has been confirmed that the hardness thereof should preferably be 0–40 (rubber hardness meter ASKER type C 25° C.), the radius of the pores should be 1–200 $\mu$m, and the porosity should be 20–95%.

The hardness of a open-pored microporous structure changes depending on the manner in which it is utilized. If it is too small, the shape can change due to the pressure at the time the stamp is pressed, and the lettering can become deformed or there can be too much ink. Conversely, if it is too large, the ink will have difficulty coming out.

If the radius of the pores of the open-pored microporous structure is too small, the ink has difficulty flowing, but if too large, there can be too much ink and cause bleeding or taking longer to dry.

Further, if the porosity is too small, the clarity or durability becomes poor, but if too large, there can be too much ink and cause bleeding or taking longer to dry.

The ink to be impregnated in the open-pored microporous structure for the ink supply member which comprises the stamp of the present invention is not specifically limited, and such inks as water-based inks of the dye type or pigment type, oil-based inks, solvent-type inks, emulsion inks, ultraviolet light setting inks, hot melt inks, etc., may be employed as long as they will remain supported within the pores of the open-pored microporous structure.

Particularly, if the viscosity of the ink to be impregnated in the open-pored microporous structure of the ink supply member is 1,000–100,000 CPS and the thixotropy index is 2.5 or less, or further preferably, if the thixotropy index is 1.0–2.5, favorable results are obtained.

If the viscosity is less than 1,000 CPS, too much ink will run out and cause bleeding. Conversely, if the viscosity exceeds 100,000 CPS, the ink will have difficulty coming out. Also, the ink will have difficulty coming out if the thixotropy index exceeds 2.5. However, if the thixotropy index is less than 1.0, there is a tendency for somewhat too much ink to flow out.

The viscosity was measured using a "B8H model viscometer" manufactured by Toki Sangyo, Inc., in a 20° C. environment. The thixotropy index was calculated using $\eta 1/\eta 2$ (wherein $\eta 1$ is the apparent viscosity at 60 rpm, and $\eta 2$ is the apparent viscosity at 300 rpm).

Regarding the thermal stencil paper 1 to be utilized for the stamp of the present invention; a porous support unit 1*b* such as Tengu paper, rayon-blend Japanese Washi paper, non-woven cloth, screening, etc., may be attached to film which melts with heat 1*a* such as polyester, polyethylene, polypropylene, polyamide, vinyl chloride-vinylidene chloride copolymer, etc., by pasting these together in layers via, e.g., an adhesive layer 1*c*. Further, a thermal stencil paper 1 which possesses a sticking-prevention layer such as silicone or fluorine on the surface of the film which melts with heat 1*a* may also be utilized.

Figure 5A:
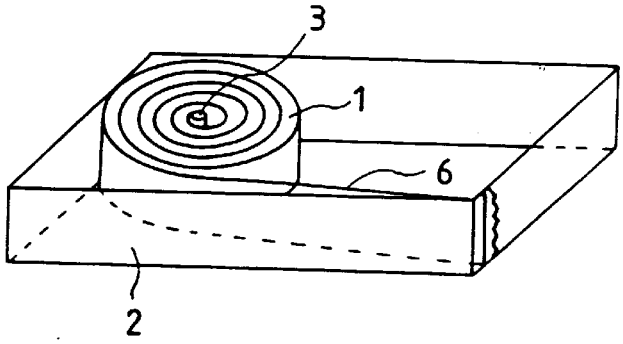
FIG. 5A is an explanatory diagram of the state of the thermal stencil paper and the reinforcing tape to reinforce the thermal stencil paper being rolled together to form a double layer onto the core, and FIG. 5B as an explanatory diagram of the mounting thereof onto the stamp cassette.
Figure 5B:
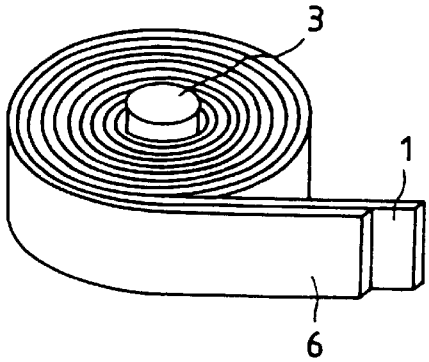

FIGS. 5A and 5B show an embodiment of the stamp cassette of the present invention. Thermal stencil paper 1 and transport-assistant tape 6 are rolled onto the core 3 as two layers, and are loaded onto the stamp cassette 2.

Regarding the transport-assistant tape 6 which reinforces the thermal stencil paper 1; high-quality paper, medium-quality paper, photogravure paper, light-weight coated paper, glassine paper, condenser paper, polyester film, PP film, etc., may be employed. However, when utilizing in an engraving machine which can convey the thermal stencil paper well, the transport-assistant tape is not necessary.

It is preferable to provide a water-repellent oil-repellent layer on the edge including the slit surface (the side of the tape formation) of the thermal stencil paper 1 (mother roll) which is wrapped onto the core 3. Regarding the water-repellent oil-repellent layer; an appropriate material should be selected which repels water-based inks, oil-based inks, solvent-type inks, emulsion inks, ultra-violet light setting type inks, etc. Examples of usable water repellent and oil repellent agents include: MODIPER F-100, MODIPER F-110, MODIPER F-200, and MODIPER F-210, manufactured by Nippon Yushi, Inc.; Asahi Guard or SURFLON manufactured by Asahi Glass, Inc.; UNIDYNE manufactured by Daikin Industries, Inc.; Defenser manufactured by Dainihon Ink Kagaku Kogyo, Inc.; and removers which possess surface active agents, silicones or fluorines with peelability can be used.

Figure 3C:
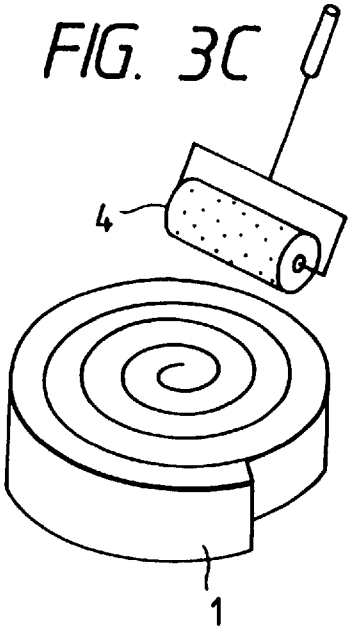
FIGS. 3A thorough 3C are explanatory diagrams of the method for forming a water-repellent oil-repellent agent layer on the edge of the thermal stencil paper which comprises the stamp of the present invention, including the slit surface (the side of the tape formation) thereof.
Figure 3B:
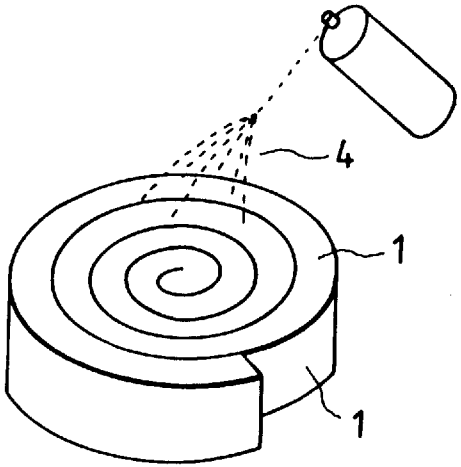
Figure 3A:
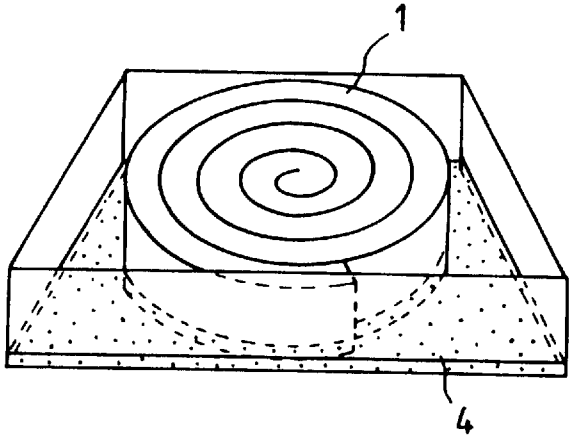
Figure 4:
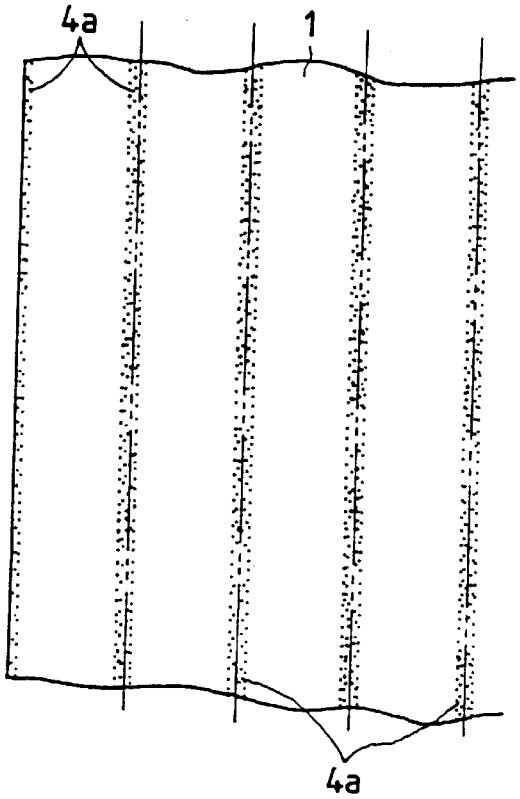
FIG. 4 is an explanatory diagram of another method for forming the water-repellent oil-repellent agent layer on the edge of the thermal stencil paper which comprises the stamp of the present invention, including the slit surface (the side of the tape formation) thereof.

The methods by which to form the water-repellent oil-repellent layer on the edge including the slit surface (the side of the tape formation) of the thermal stencil paper 1 (mother roll) include: immersing a portion in a solution 4 which has the selected water-repellent oil-repellent agent dissolved in a solvent, as FIG. 3A shows; or atomizing the aforementioned solvent as FIG. 3B shows; or, as FIG. 3C shows, coating methods such as utilizing a roller 5 which has been impregnated with the aforementioned solvent 4 to coat so that the impregnation is at approximately the depth of 1 mm in the slit surface of the thermal stencil paper 1, may be employed. Further, during the process of manufacturing the thermal stencil paper 1, the water-repellent oil-repellent agent may coat the planned slit locations; or as FIG. 4 shows, the water-repellent oil-repellent agent 4*a* may coat the planned slit locations (shown in FIG. 4 by broken lines) of the pre-fabricated mother roll of the thermal stencil paper 1. In this instance, it goes without saying that the completed item would be slit.

As previously noted, the thermal stencil paper 1 on which is formed the water-repellent oil-repellent layer on the edge including the slit surface (the side of the tape formation) and the transport-assistant tape 6 which reinforces this, as FIG. 5B shows, is rolled onto core 3 together as two layers, and as FIG. 5A shows, is mounted on the stamp cassette 2.

In doing so, if the thermal stencil paper 1 can be rolled onto core 3 without any adhesive, and if the thermal stencil paper 1 and the transport-assistant tape 6 do not have to be pasted together, the result is such which does not have any wrinkles due to the difference in the outer circumference and the inner circumference.

Figure 6:
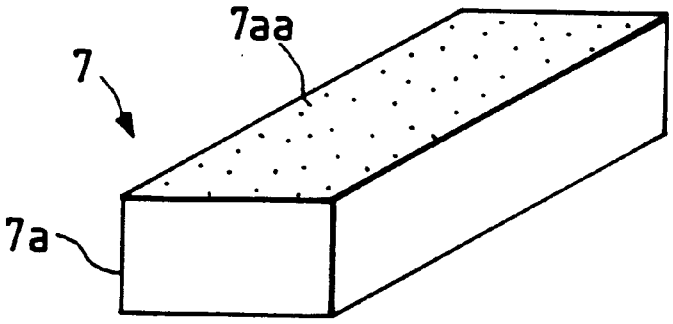
FIG. 6 is an explanatory diagram of a situation wherein the outer surfaces of the open-pored microporous structure of the ink supply member which comprises the stamp of the present invention, other than the surfaces which are in contact with the thermal stencil paper, are made impermeable to ink.

It is desirable to make the open-pored microporous structure 7*a* of the ink supply member 7, which comprises the stamp of the present invention, impermeable to ink except for the surface 7*a* which comes in contact with the thermal stencil paper 1, as shown in FIG. 6. Regarding this impermeable layer, the follow-up on the shape change when conducting stamping (if it is not an even, flat surface, there will be an unevenness in the printed characters) and the adhesive quality (if the adhesion between the open-pored microporous structure and the material which makes the ink impermeable is poor, it can peel apart after repeated use) is good in the event of using the same material as the open-pored microporous structure 7*a*. However, a silicone resin or a rubber, other than the same type of material as the open-pored microporous structure, can also be used. In such an instance, if something with a hardness of 0–40 (rubber hardness meter ASKER type C 25° C.) is utilized, when the stamp is pressed, there will not be any excess ink coming from the open-pored microporous structure 7*a* which is impregnated with ink, and there will not be any ink leakage from the thermal stencil paper 1, and thus clear stamping results can be obtained repeatedly.

Concerning the method by which the surfaces other than the surface which the thermal stencil paper 1 is in contact with the open-pored microporous structure of the ink supply member which is used in the stamp of the present invention are made impermeable to ink; the Figure has been omitted, but as in the instance where the water-repellent oil-repellent layer is formed on the edge including the slit surface (the side of the tape formation) of the thermal stencil paper 1, a liquid containing the material which has been dissolved by a solvent may be atomized, or part of the tape formation may be only partially immersed the aforementioned solution, or a roller impregnated with the aforementioned solution may be used for coating, and further, the solution which makes the ink impermeable can be coated onto a base material which has peelability properties, and while this has not yet dried or hardened, the open-pored microporous structure of the ink supply member is place thereupon and then dried or hardened, then subsequently the base material is removed so as to form an even film, and such film can also be pasted together with an adhesive.

EXAMPLES

The following is a description of the results of the experiment performed in order to describe the effects of the stamp and stamp cassette of the present invention.

A thermal stencil paper, fabricated by pasting together a screen and a polyester film 2 μm thick, is slit to a 18 mm width so as to fabricate a mother roll for the thermal stencil paper.

A water-repellent, oil-repellent agent was atomized so that this material was impregnated to a depth of approximately 1 mm into both slit surfaces of the thermal stencil paper.

Next, samples were rolled onto the core of cassettes for "Nameland", manufactured by Casio Computer Co., Ltd., thereby fabricating rolls of the material, and original plates were created by engraving by means of the aforementioned machine, the aforementioned samples being: a sample that was rolled onto the core with transport-assistant tape but without adhesive (embodiments except for Embodiment 20); and a sample without transport-assistant tape (Embodiment 20).

The open-pored microporous structure of the ink supply member was impregnated with ink, wherein the outer surfaces other than the surfaces where the thermal stencil paper is in contact was made impermeable to ink. Then the original plate was affixed thereto using only the surface tension of the ink, and stamps were created as shown in Table 1 below.

Evaluation was made by visual observation, and those which had a good consistency and clarity and the durability of the stamped type was over 2,000 times was marked with an A, those which had a good consistency and clarity and the durability of the stamped type was over 1,000 times was marked with a B, those which had a good consistency and clarity and the durability of the stamped type was over 500 times was marked with a C, and those which did not have a good consistency or clarity and the durability of the stamped character was under 500 times was marked with a D. Embodiment 20 did not have the transport-assistant tape and could not convey the thermal stencil paper, and therefore could not be evaluated.

TABLE 1

| | Open-pored microporous structure | | | | Ink | | | Water-repellent, oil repellent agent | Ink impermeating agent | |
|---|---|---|---|---|---|---|---|---|---|---|
| Embodiment | Material | Hardness | Pore diameter (mm) | Porosity (%) | Viscosity CPS | TI value | Transport-assistant tape Material | Material | Material [Hardness] | Evaluation |
| 1 | Polyurethane | 0 | 100 | 80 | 5000 | 1.0 | High-quality paper | MODIPER F-210 | Synthetic rubber [30] | A |
| 2 | Polyurethane | 15 | 100 | 80 | 6000 | 1.1 | High-quality paper | Same as above | Synthetic rubber [30] | A |
| 3 | Polyurethane | 30 | 100 | 80 | 1000 | 1.0 | High-quality paper | Same as above | Silicone resin [30] | A |
| 4 | Polyurethane | 40 | 100 | 80 | 6000 | 1.1 | High-quality paper | Same as above | Silicone resin [30] | B |
| 5 | Polyurethane | 50 | 100 | 80 | 6000 | 1.1 | High-quality paper | Same as above | Silicone resin [30] | C |
| 6 | NBR | 30 | 0.5 | 80 | 10000 | 2.5 | Glassine paper | Asahi Guard | Rubber [30] | D |
| 7 | NBR | 30 | 100 | 80 | 10000 | 2.5 | Glassine paper | Same as above | Rubber [30] | A |
| 8 | NBR | 30 | 200 | 80 | 10000 | 2.5 | Glassine paper | Same as above | Rubber [30] | A |
| 9 | NBR | 30 | 250 | 80 | 10000 | 2.5 | Glassine paper | Same as above | Rubber [30] | D |

TABLE 1-continued

| Embodiment | Open-pored microporous structure: Material | Hardness | Pore diameter (mm) | Porosity (%) | Ink: Viscosity CPS | TI value | Transport-assistant tape Material | Water-repellent, oil repellent agent Material | Ink impermeating agent Material [Hardness] | Evaluation |
|---|---|---|---|---|---|---|---|---|---|---|
| 10 | Polyurethane | 40 | 100 | 15 | 5000 | 1.0 | High-quality paper | MODIPER F-210 | Silicone resin [30] | D |
| 11 | Polyurethane | 40 | 100 | 20 | 5000 | 1.0 | High-quality paper | Same as above | Silicone resin [30] | B |
| 12 | Polyurethane | 40 | 100 | 95 | 5000 | 1.0 | High-quality paper | Same as above | Silicone resin [30] | A |
| 13 | Polyurethane | 40 | 100 | 98 | 5000 | 1.0 | High-quality paper | Same as above | Silicone resin [30] | C |
| 14 | Polyurethane | 5 | 100 | 80 | 800 | 1.0 | High-quality paper | Surface active agent | Rubber [30] | C |
| 15 | Polyurethane | 5 | 100 | 80 | 100000 | 1.0 | High-quality paper | Same as above | Rubber [30] | A |
| 16 | Polyurethane | 5 | 100 | 80 | 110000 | 1.0 | High-quality paper | Same as above | Rubber [30] | C |
| 17 | Polyurethane | 5 | 100 | 80 | 5000 | 1.0 | High-quality paper | UNIDYNE | Rubber [30] | B |
| 18 | Polyurethane | 5 | 100 | 80 | 5000 | 2.5 | High-quality paper | Same as above | Rubber [30] | A |
| 19 | Polyurethane | 5 | 100 | 80 | 5000 | 2.6 | High-quality paper | Same as above | Rubber [30] | C |
| 20 | Polyurethane | 5 | 100 | 80 | 5000 | 1.0 | None | MODIPER F-210 | Rubber [30]— | |
| 21 | Polyurethane | 5 | 100 | 80 | 5000 | 1.0 | High-quality paper | Same as above | Rubber [15] | A |
| 22 | Polyurethane | 5 | 100 | 80 | 5000 | 1.0 | High-quality paper | Same as above | Rubber [20] | A |
| 23 | Polyurethane | 5 | 100 | 80 | 5000 | 1.0 | High-quality paper | Same as above | Rubber [40] | A |
| 24 | Polyurethane | 5 | 100 | 80 | 5000 | 1.0 | High-quality paper | Same as above | Rubber [45] | C |

EFFECTS OF THE INVENTION

As described above, in the instance where the stamp cassette and stamp according to the present invention are used, known complex engraving procedures are not necessary, and multiple types of printing and multiple copies thereof are available at a low cost. In the instance where the stamp cassette has the water-repellent, oil-repellent layer on the slit surface of the thermal stencil paper, or in the instance where the stamp is used which is impermeable to ink on the surfaces other than the surface in contact with the thermal stencil paper of the open-pored microporous structure, the printing can be conducted with higher clarity. Further, in the case where a stamp cassette is used and the thermal stencil paper is rolled onto the core without an adhesive agent, there is no wrinkling resulting from the difference in the outer circumference and the inner circumference.

What is claimed is:

1. A stamp cassette comprising:

a thermal stencil paper;

a transport-assistant tape layered with but unbonded to said thermal stencil paper; and a stamp cassette housing for housing said thermal stencil paper and said transport-assistant tape, wherein said thermal stencil paper and said transport-assistant tape to reinforce it are wound together in two layers about a core in said stamp cassette housing.

2. A stamp cassette according to claim 1, wherein said thermal stencil paper is rolled onto said core without an adhesive.

3. A stamp cassette according to claim 1, further comprising a water-repellant oil-repellent coating on an edge of said thermal stencil paper, including slit surfaces formed between layers thereof.

4. A stamp cassette according to claim 3, wherein said water-repellant oil-repellant layer is coated onto said edge of said thermal stencil paper including said slit surfaces after said thermal stencil paper is wound onto said core.

* * * * *

UNITED STATES PATENT AND TRADEMARK OFFICE

CERTIFICATE OF CORRECTION

PATENT NO. : 5,970,868

DATED : October 26, 1999

INVENTOR(S): MASARU KIMURA, ET AL.

It is certified that error appears in the above-identified patent and that said Letters Patent is hereby corrected as shown below:

COLUMN 7:

TABLE 1-continued, "Rubber [30]-" should read --Rubber [30] - --.

COLUMN 8:

Line 47, "oil-repellent" should read --oil-repellant--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*